US006672935B1

(12) United States Patent
Lund et al.

(10) Patent No.: US 6,672,935 B1
(45) Date of Patent: Jan. 6, 2004

(54) SOMERSAULTING FIGURE

(75) Inventors: Bruce D. Lund, Chicago, IL (US); Krishnan Srirangam, Chicago, IL (US); Michael Starrick, Maywood, IL (US); Sunil Moothedath, Chicago, IL (US)

(73) Assignee: Lund & Company, Chicago, IL (US)

( * ) Notice: Subject to any disclaimer, the term of this patent is extended or adjusted under 35 U.S.C. 154(b) by 0 days.

(21) Appl. No.: 10/191,861

(22) Filed: Jul. 10, 2002

(51) Int. Cl.[7] ..... A63H 11/00
(52) U.S. Cl. ..... 446/330; 446/175; 446/353
(58) Field of Search ..... 446/330, 324, 446/175, 352, 353, 354, 356

(56) References Cited

U.S. PATENT DOCUMENTS 3,500,577 A * 3/1970 Bart ..... 446/324
3,728,815 A * 4/1973 Tomiyama ..... 446/291
3,828,462 A * 8/1974 Morrison et al. ..... 446/167
4,530,672 A * 7/1985 Yoneda ..... 446/324
4,740,186 A * 4/1988 Sirota ..... 446/175
5,739,655 A * 4/1998 Torii et al. ..... 446/356
5,759,082 A * 6/1998 Kujawski et al. ..... 446/139
5,928,055 A * 7/1999 Gramsch ..... 446/324

* cited by examiner

*Primary Examiner*—Derris H. Banks
*Assistant Examiner*—Urszula M Cegielnik

(57) ABSTRACT

The present invention includes a toy figure that is hinged at the waist. The hinged waist permits the figure to pivot or move the top half of the body relative to the bottom half. A control mechanism controls the movement such that the figure will move from a standing position through a "somersault" ending back in a standing position again. In other embodiments the control mechanism can stop the movement or pose the figure in a position, such as a "headstand" or a position prior to a headstand. When the figure stops the movement prior to a headstand, the figure can prompt a user to assist the figure in completing the headstand. When the user helps the figure in completing the headstand, the figure could continue to perform a somersault or flip over.

13 Claims, 2 Drawing Sheets

SOMERSAULTING FIGURE

BACKGROUND OF THE INVENTION

Toy figures have always been the mainstay as a toy for young children. There have been numerous varieties of figures from no interaction to fully interactive figures. There exist figures that speak, cry, sing and laugh in response to a child touching or squeezing various parts of the figure, as well as figures that walk and crawl. However, there are always a continual need for improvements and new and novel features.

SUMMARY OF THE INVENTION

There is herein described and illustrated a unique animated figure that is hinged at the waist. The hinged waist permits the figure to pivot or move the top half of the body relative to the bottom half. A control mechanism controls the movement in such a manner that the figure will move from a standing and upright position through a forward somersault ending back in a standing and upright position. In other embodiments the control mechanism can stop the movement or pose the figure in a position, such as a "headstand" or a position prior to a headstand. When the figure stops the movement prior to a headstand, the figure can prompt a user to assist the figure in completing the headstand. When the user helps the figure in completing the headstand, the figure could continue to perform a somersault or flip over.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
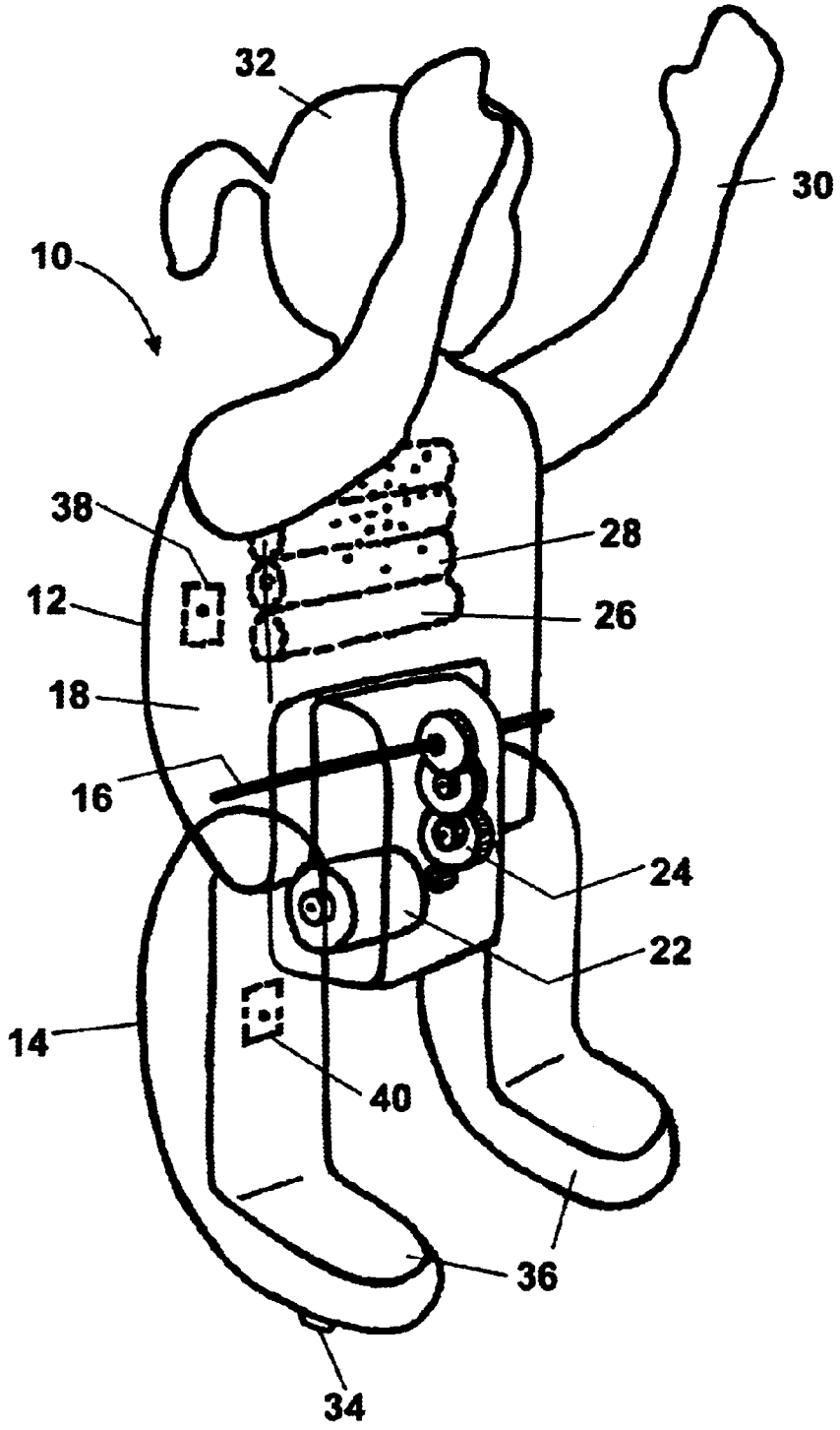
FIG. 1 is a partial see-through perspective view of the Figure in accordance with the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1 a figure in accordance with the present invention is illustrated and referenced generally as numeral 10. The figure 10 includes a torso 12 that is hinged to a pair of legs 14 about a pivot pin 16 through the waist region 18. A gearbox housing 20 houses a reciprocating motor 22 that rotates a gear train 24, which is in connection with the legs 14 and torso 12 about the pivot pin 16, such that the legs 14 and torso 12 may be moved or pivoted towards or away from each other. The motor 22 is powered by a power supply 26 that is preferably a battery pack. A circuit board (not shown) controls the motor 22 and a speaker 28 in accordance with pre-programmed instructions.

The figure 10 further includes a pair of poseable arms 30 that preferably include detents to temporarily lock the arms 30 into a specific or predetermined position. Alternatively, the arms 30 may also be fixed in a single position. The figure 10 also includes a head 32, which may be fixed or poseable. The figure 10 further includes an on/off switch, but may also be deactivated with a timer mechanism.

A foot switch 34 located on the bottom of one of the feet 36, attached to the legs 14, detects whether the figure 10 is standing. A pair of ball switches 38 and 40 is separately located in the torso 12 and in one of the legs 14, respectively. The torso positioned ball switch 38 detects if the figure 10 is upright or upside down, while the leg positioned ball switch 40 detects whether the feet are in the up or down position. The combination of the ball switches 38 and 40 and the foot switch 34 indicate to the circuit board the position of the figure 10 at any given time. This ensures that the circuit board can properly instruct or control the motor 22 such that the figure 10 is able to complete various actions such as but not limited to somersaults or headstands.

Figure 2:
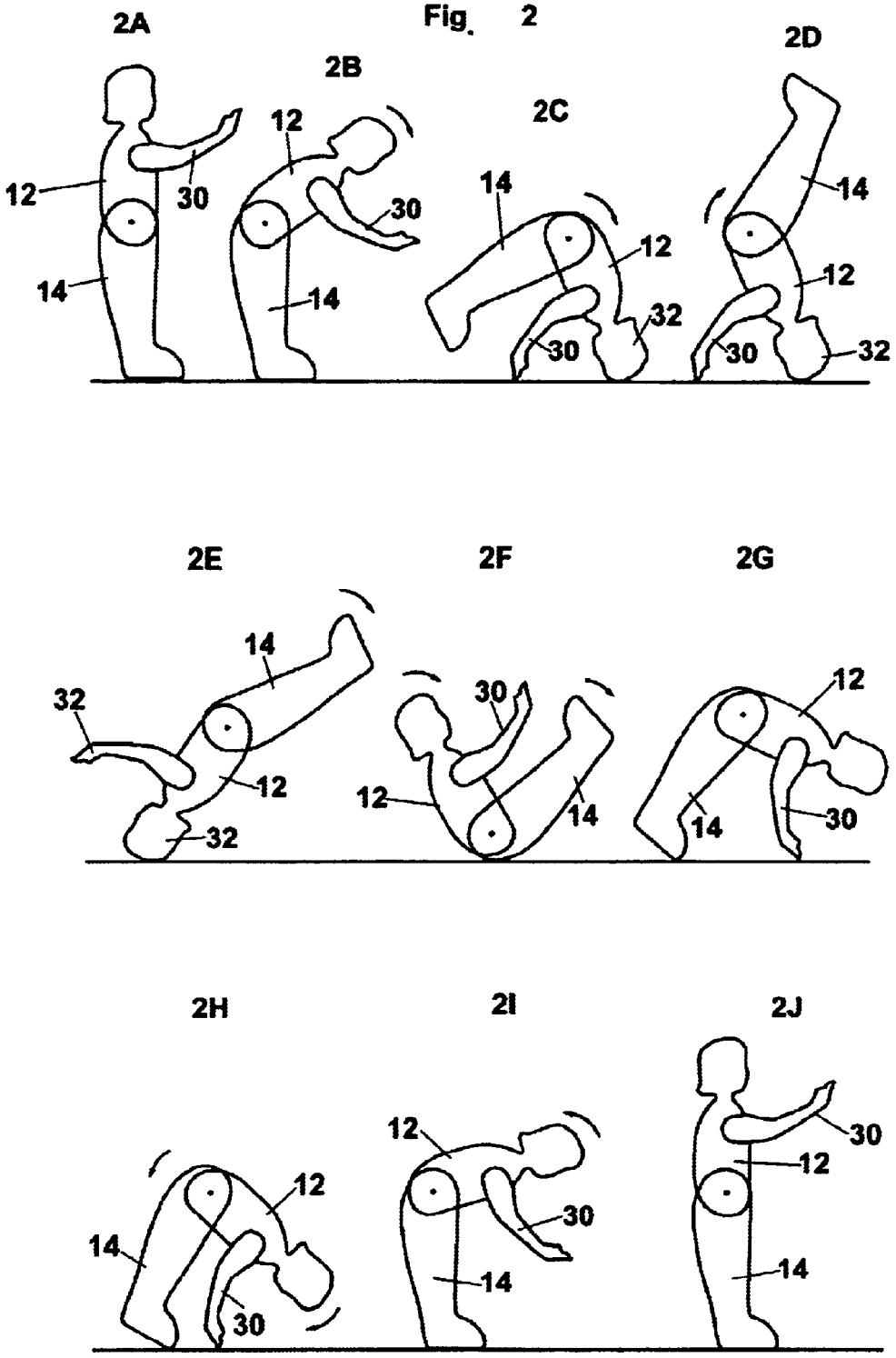
FIG. 2 illustrates the figure, from FIG. 1, in various positions when somersaulting.

In the following description, one method of operation will be discussed, it being further realized that other methods may be used without deviating from the scope of the present invention. Referring now to FIG. 2, the figure 10 is illustrated in various positions that the FIG. 10 will undergo while performing various actions such as a somersault or headstand. It should be further understood that while not specifically stated throughout, the motor 22 is controlled by the circuit board in accordance with preprogrammed instructions. The circuit board may also determine the position of the figure 10 throughout the various actions or movements as necessary by receiving and interpreting signals from the ball switches 38 and 40 and the foot switch 34.

When the figure 10 is placed on the feet 36 and is in a substantially upright position (FIG. 2*a*) the figure may emit pre-programmed speech, such as "I'm going to do a somersault." Then the figure 10 goes through a series of motions (FIGS. 2*b* and 2*c*) that make the figure 10 assume a stable position on its head 32 and arms 30. This is accomplished by controlling the motor 22 to pivot the torso 12 forwardly towards the legs 14 (FIG. 2*b*). At some point gravity will pull the figure 10 forwards such that the feet 34 are lifted off of the ground and the figure 10 is resting on its head 32 and arms 30 (FIG. 2*c*). The motor 22 is then reversed such that the legs 14 are moved away from the torso 12, or positioned above the torso 12 (FIG. 2*d*). The legs 14 are then moved forward in a small, quick movement throwing the figure 10 off balance, tipping the figure 10 over backwards (FIG. 2*e*). The motor 22 is then quickly reversed so that the torso 12 begins to move towards the legs 14 again (FIG. 2*f*). The figure 10 is now almost in the shape of a ball and the curves (in the outside profile of the legs 14) and weight of the figure 10 assist the momentum of the figure 10 to roll. The figure 10 rolls forward until the figure tumbles over and lands on her arms (FIG. 2*g*). From this stable position, the motor 22 is controlled to move the torso 12 towards the legs 14 (FIG. 2*h*) until the figure 10 is positioned in a stable position on the feet 3 and thereby returned to a standing position. The circuit board would be able to determine that the figure 10 is standing again when the foot switch 34 is reactivated. The torso 12 of the figure 10 is then moved backwards (FIG. 2*i*) by reversing the motor 22 until the figure 10 is fully erect (FIG. 2*j*). The figure 10 may then emit a sentence, such as "Ta-da", or another exclamation of accomplishment could be used.

In another action, such as a headstand the figure 10 could be controlled to pose in a position indicated by FIG. 2*c*. The figure 10 will then emit sounds such as "Help me do a headstand Lift my feet." When the user assists the figure by lifting the legs 14 to a substantially vertical position, the ball switch one of the legs 14 will detect the movement and prompt the figure to say, "Thank you." From this position, the figure 10 may continue automatically (without the aid of the user) with a somersault as described above or flip over through the positions described through FIG. 2*f*. When the figure 10 flips over (to FIG. 2*f*), the figure 10 could say, "I did a headstand, could you help me stand up." Alternatively, the figure 10 upon stopping in a headstand position, could say "Look I'm doing a headstand," and then after waiting a predetermined amount of time, could continue with the somersault of simply flip over onto its backside.

From the foregoing and as mentioned above, it will be observed that numerous variations and modifications may be effected without departing from the spirit and scope of the novel concept of the invention. It is to be understood that no limitation with respect to the specific methods and/or apparatus illustrated herein is intended or should be inferred. It is, of course, intended to cover by the appended claims all such modifications as fall within the scope of the claims.

We claim:

1. A figure comprising: a torso hingedly attached to a pair of legs; a motor means attached to the torso and legs for moving the torso and legs toward and away from each other; a control means in communication with the motor means for controlling the motor means in accordance with a set of preprogrammed instructions that cause the figure to perform a somersault, and; further comprising a plurality of switches in communication with the control means such that the control means upon receiving a signal from the switches is able to determine the position of the figure.

2. The figure of claim 1 wherein one of the switches is located in one of the legs and another switch is located in the torso, whereby the control means upon receiving signals from said switches in the leg and torso is able to determine the position of the legs and torso.

3. A somersaulting figure comprising: a torso hingedly attached to a pair of legs; a head and a pair of poseable arms, which have a pre-determined position that assist the figure in performing a somersault; a motor mechanism attached to the torso and legs for moving the torso and legs towards and away from each other; a means for controlling the motor mechanism in accordance with a set of pre-programmed instructions that causes the figure to perform said somersault starting from and ending in a standing and upright position and further comprising a plurality of switches in communication with the control means such that the control means upon receiving a set of signals from the switches is able to determine a position of the figure.

4. The figure of claim 3, wherein the one of the switches is located in one of the legs and another switch is located in the torso, whereby the control means upon receiving signals from said switches in the leg and torso is able to determine the position of the legs and torso.

5. The figure of 4, wherein another switch is located on a bottom portion of a foot that is attached to a leg, defined as a foot switch, said foot switch being activated when said foot is positioned on a surface whereby the control means upon receiving a signal from said foot switch is able to determine whether the figure is standing.

6. The figure of claim 5, wherein the control means controls the motor means in accordance with another set of pre-programmed instructions that cause the figure to perform a headstand.

7. A somersaulting toy figure comprising: a torso hingedly attached to a pair of legs, each leg further including a foot; a head and a pair of poseable arms, which have a predetermined position that assists the toy figure in performing a somersault; a motor mechanism attached to the torso and legs for moving the torso and legs towards and away from each other; a means for controlling the motor mechanism such that the torso and legs move through a set of positions that causes the toy figure to perform a somersault, when the toy figure is in a standing and substantially upright position; a foot switch positioned beneath one of the feet such that the foot switch is activated when the toy figure is standing on a surface, the foot switch further being in communication with the controlling means such that the controlling means is able to determine when the toy figure is standing; and a pair of ball switches separately located in the torso and one of the legs, each ball switch further being in communication with the controlling means such that the controlling means is able to determine when the legs and torso are in a substantially upright position, whereby the controlling means upon detecting that the toy figure is in a substantially upright and standing position is able to move the toy figure through said set of positions causing the toy figure to perform a somersault.

8. The toy figure of claim 7, wherein the controlling means is further able to stop the toy figure in a predetermined position, defined in the set of positions.

9. The toy figure of claim 8, wherein said pre-determined position is further defined as a headstand.

10. The toy figure of claim 8, wherein said pre-determined position is a position defined prior to a headstand position.

11. The toy figure of claim 10, wherein when a user assists the toy figure in completing a headstand position by moving the legs of the figure to a substantially vertical position, the controlling means able to detect, from the ball switch in one of the legs, that the legs are in a substantially vertical position is further able to continue moving the figure in accordance with the set of positions.

12. The toy figure of claim 7, wherein upon completing a somersault the toy figure maintains a standing and upright position.

13. The figure of claim 12 further comprising a speaker in communication with the control means for emitting prerecorded sounds.

* * * * *